US006172462B1

(12) United States Patent
Gibson et al.

(10) Patent No.: US 6,172,462 B1
(45) Date of Patent: Jan. 9, 2001

(54) CERAMIC METAL HALIDE LAMP WITH INTEGRAL UV-ENHANCER

(75) Inventors: Ray G. Gibson, Bath; Samuel A. Carleton, Hammondsport; Andrew D. Jackson, Bath, all of NY (US)

(73) Assignee: Philips Electronics North America Corp., New York, NY (US)

( * ) Notice: Under 35 U.S.C. 154(b), the term of this patent shall be extended for 0 days.

(21) Appl. No.: 09/439,453

(22) Filed: Nov. 15, 1999

(51) Int. Cl.[7] ..... H01J 61/35
(52) U.S. Cl. ..... 313/594; 313/635; 313/607
(58) Field of Search ..... 313/625, 607, 313/635, 634, 594, 234, 25, 42, 47

(56) References Cited

U.S. PATENT DOCUMENTS 4,499,406 * 2/1985 Saburo ..... 313/594
4,818,915 4/1989 Zaslavsky et al. ..... 315/60
5,162,693 * 11/1992 Van Der Leeuw et al. ..... 313/635
5,541,480 7/1996 Renardus et al. ..... 313/365
5,661,367 8/1997 Fellows et al. ..... 315/59
5,811,933 9/1998 Van Den Nieuwenhuizen et al. 313/570

* cited by examiner

*Primary Examiner*—Michael H. Day
(74) *Attorney, Agent, or Firm*—F. Brice Faller

(57) ABSTRACT

Discharge lamp includes a ceramic metal halide lamp having a central barrel enclosing a discharge space containing a fill gas and opposed end plugs which receive electrode lead-ins therethrough. A conductive ring is provided around each end plug, which is preferably polycrystalline alumina (PCA). These rings are connected by an antenna on the central barrel and thereby capacitively coupled to the lead-ins. The rings and the antenna are preferably sintered tungsten which is coated on the arc tube in paste form prior to sintering. When a voltage is applied across the electrodes, the resulting electric field causes the PCA to emit UV radiation which stimulates photoelectrons to initiate a discharge in the fill gas.

7 Claims, 2 Drawing Sheets

CERAMIC METAL HALIDE LAMP WITH INTEGRAL UV-ENHANCER

BACKGROUND OF THE INVENTION

The invention relates to a high pressure discharge lamp having a ceramic metal halide arc tube enclosing a discharge space with a pair of electrodes, and means for generating ultraviolet (UV) radiation which produces electrons in the discharge space.

U.S. Pat. No. 4,818,915 discloses a ceramic metal halide discharge lamp having a UV-enhancer in the form of a so-called glow bottle having an electrode in an envelope of UV transmitting borosilicate glass or quartz. The electrode is connected to a lead-in of one of the arc tube electrodes, and the envelope is capacitively coupled to the other arc tube lead-in. Application of an ignition voltage pulse across the arc tube electrodes creates an electric field passing through the fill gas of the glow bottle, which is preferably inert gas and mercury. This in turn produces UV radiation which stimulates emission of electrons from at least one of the electrodes in the discharge space by the photoelectric effect. These photoelectrons enhance gas breakdown and initiation of a discharge between the arc tube electrodes, thereby reducing starting time of the lamp. However ignition voltage pulses on the order of 5 kV are required to produce UV radiation.

U.S. Pat. No. 5,811,933 discloses a UV-enhancer in the form of a glow bottle having an envelope of ceramic material such as polycrystalline alumina (PCA) and a filling of inert gas. The use of ceramic reduces the minimum required ignition pulse voltage for reliable ignition to under 3 kV without appreciably increasing ignition time. The ceramic also has very good heat resistance, which renders it possible to position the UV enhancer very close to the arc tube. Capacitive coupling to the arc tube electrode is thereby achieved directly, without any additional conductor.

U.S. Pat. No. 5,541,480 discloses a high pressure discharge lamp with a ceramic metal halide arc tube having an outer surface on which a metallic coating is present. The coating extends along the length of the arc tube between electrodes and serves as a so-called ignition strip or starting antenna. The antenna capacitively couples the high voltage pulse from an electrode, through the fill gas and the ceramic, to the antenna, and finally to the other electrode. This reduces the apparent distance between electrodes and therefore increases the applied electric field which accelerates primary electrons and initiates the so-called Townsend avalanche. This occurs when at least one secondary electron is emitted in the fill gas for each primary electron, and the discharge current becomes self-sustaining.

U.S. Pat. No. 5,661,367 discloses a lamp having side-by-side ceramic metal halide arc tubes connected in series, with a metal strap capacitively coupling electrodes of respective arc tubes. The arc tubes each have a central barrel with opposed end plugs and electrodes extending therethrough, and the strap has end portions looped around electrically opposed end plugs close to the respective barrels. A gap is present between the electrodes and the inside surface of the end plugs. According to the specification, the electric field induces ionization of the fill gas in this gap. This produces radiation which in turn ensures emission of electrons from the electrodes. Once a gas discharge is supported, the impedance of the arc tube is reduced and the other arc tube sees the entire energy of subsequent starting pulses.

SUMMARY OF THE INVENTION

According to the invention, conductive rings are coated directly on each end plug of a ceramic metal halide arc tube.

These rings are connected by a coated antenna and thus capacitively coupled to electrode lead-ins in the plugs when an ignition pulse is applied. This capacitive coupling produces an electric field in the ceramic which causes it to emit UV radiation.

It is important for the contact between the rings and the ceramic to be intimate, which is why it is coated. The ceramic is preferably polycrystalline alumina (PCA), which has been found to generate more intense UV than other ceramics. A preferred coating is tungsten, which is applied in a paste and dried on a previously baked molded piece, whereupon the piece is sintered to achieve translucence. This process is described in U.S. Pat. No. 5,541,480 for the manufacture of an antenna on the surface of a ceramic arc tube. The sintering also causes the tungsten to permeate the crystal structure of the alumina, creating an intimacy which promotes generation of UV by the PCA.

The invention resides in the discovery that ceramic, in particular PCA, emits ultraviolet radiation when exposed to an electric field therethrough. Therefore, providing capacitively coupled conductive rings around the end plugs provides a device for stimulating emission of primary electrons and reliably reducing starting times without using a glow bottle. Coating the rings and a connecting antenna directly on the arc tube not only provides a strong electric field in the PCA but eliminates the need for a separate part, thereby reducing manufacturing cost.

DETAILED DESCRIPTION OF THE PREFERRED EMBODIMENT

Figure 1:
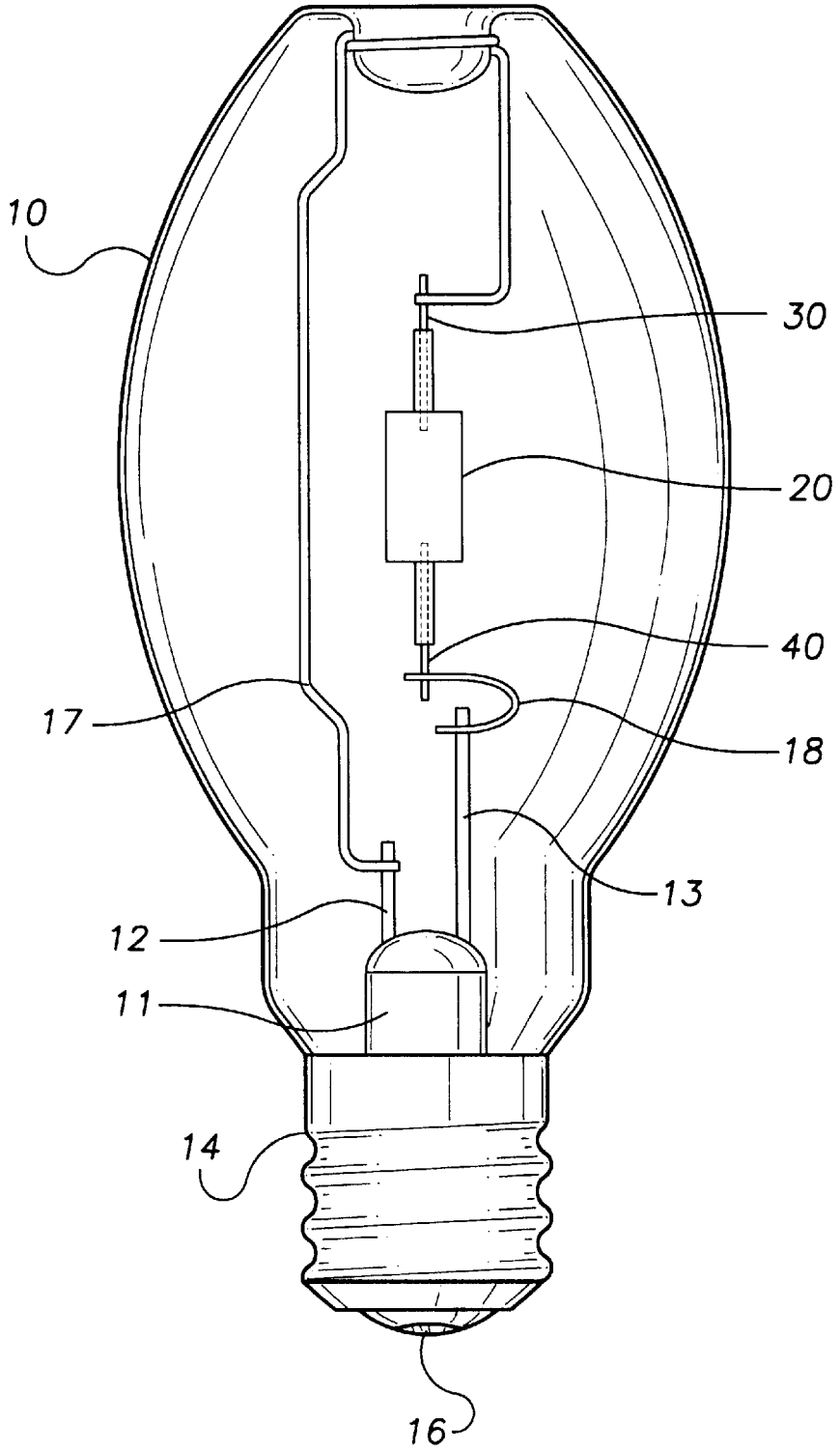
FIG. 1 is an elevation view of a discharge lamp.

Referring to FIG. 1, a ceramic metal halide discharge lamp comprises a glass outer envelope 10, a glass stem 11 having a pair of conductive support rods 12, 13 embedded therein, a metal base 14, and a center contact 16 which is insulated from the base 14. The rods 12, 13 are connected to the base 14 and center contact 16, respectively, and not only support the arc tube 20 but supply current to the electrodes 30, 40 via wire support members 17, 18.

Figure 2:
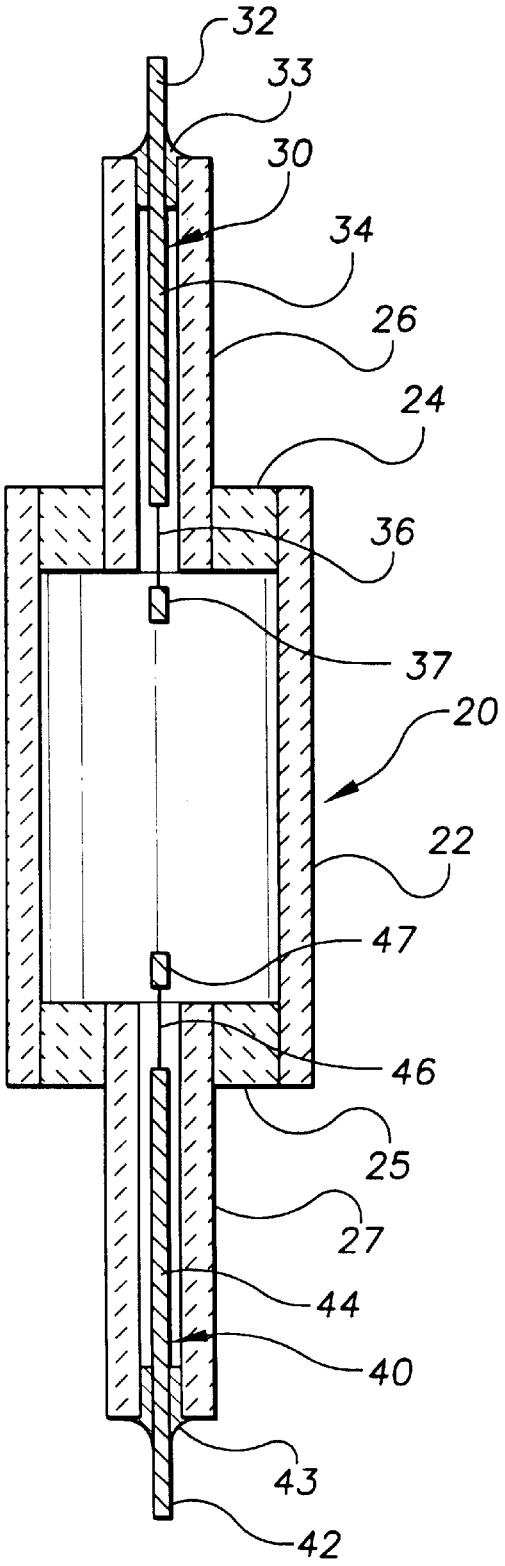
FIG. 2 is a cross-section of a ceramic metal halide arc tube.

FIG. 2 shows the arc tube 20 in cross-section. The central barrel 22 is formed as a ceramic tube having disc-like end walls 24, 25 with central apertures which receive end plugs 26, 27. The end plugs are also formed as ceramic tubes, and receive electrodes 30, 40 therethrough. The electrodes 30, 40 each have a lead-in 32, 42 of niobium which is sealed with a frit 33, 43, a central portion 34, 44 of molybdenum or cermet, and a tip 36 having a winding 37 of tungsten. The barrel 22 and end walls 24, 25 enclose a discharge space 21 containing an ionizable filling of an inert gas, a metal halide, and mercury.

As used herein, "ceramic" means a refractory material such as a monocrystalline metal oxide (e.g. sapphire), polycrystalline metal oxide (e.g. polycrystalline densely sintered aluminum oxide and yttrium oxide), and polycrystalline non-oxide material (e.g. aluminum nitride). Such materials allow for wall temperatures of 1500–1600 K and resist chemical attacks by halides and Na. For purposes of the present invention, polycrystalline aluminum oxide (PCA) has been found to be most suitable.

Figure 3:
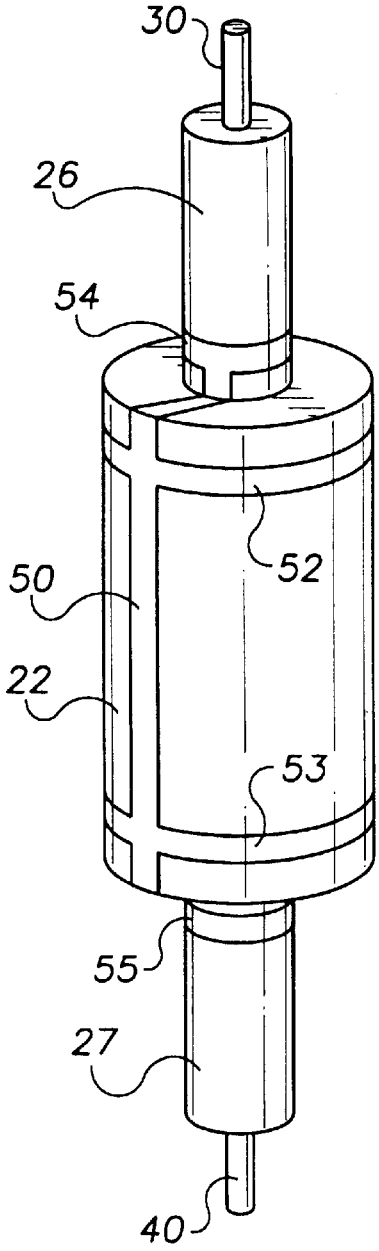
FIG. 3 is a perspective of an arc tube according to the invention.

FIG. 3 shows a ceramic metal halide arc tube having a conductive antenna stripe 50 extending along the length of barrel 22 and connecting rings 52, 53 surrounding the electrode tips, as known from U.S. Pat. No. 5,541,480. The rings 52, 53 are part of the antenna. According to the invention, the antenna stripe 50 extends radially over the end walls of the barrel 22 and electrically connects the so-called UV enhancer rings 54, 55 on the end plugs 26, 27. The antenna 50 not only reduces the breakdown voltage at which the fill gas ionizes, but electrically connects the rings 54, 55 so that a capacitive coupling exists between each ring and the adjacent lead-in in the plug when a voltage is applied across the electrodes. An electric field is thereby induced in the PCA of the end plugs. This in turn stimulates UV emission in the PCA, which in turn causes primary electrons to be emitted by the electrode. The presence of these primary electrons hastens ignition of a discharge in the fill gas.

In order to have a strong enough electric field in the PCA to generate UV light, the rings must be in intimate contact with the PCA. The rings are therefore coated directly on the PCA. The coating is preferably tungsten or other metal which is applied in paste form and baked on so that it extends into the PCA end plugs. While it is not critical for the connecting antenna to be in intimate contact, for convenience of manufacture all rings 52–55 and the antenna stripe 50 are coated on the arc tube as a continuous layer. The coating material may also be graphite.

Applicants tested a PCA arc tube with and without enhancer rings around the end plugs. Identical PCA arc tubes having an internal diameter of 6.8 mm and an internal length of 26 mm, and a xenon fill pressure of 100 torr, were used for both cases. The enhancer rings were graphite drawn on the end plugs and connected by an antenna drawn on the barrel with a no. 2 pencil. The antenna-only case utilized a molybdenum wire next to the barrel along its length, but not extending to the end plugs. The wire was connected to the adjacent current-carrying support wire by a bimetal strip which moves the antenna away after ignition. The time to breakdown and ignition was 0.02 second with the graphite enhancer rings, and 300 seconds without the enhancer rings (wire antenna only). A similar test was run using PCA arc tubes having an internal diameter of 4.0 mm and an internal length of 36 mm. The ignition time was 0.04 second with the graphite enhancers and 156 seconds without (wire antenna only). For large scale production, tungsten sintering technology would be more suitable.

The foregoing is exemplary and not intended to limit the scope of the claims which follow.

What is claimed is:

1. A discharge lamp comprising an arc tube, said arc tube comprising a cylindrical barrel having a central axis and a pair of opposed end walls, a pair of ceramic end plugs extending from respective end walls along said axis, a pair of lead-ins extending through respective end plugs, said lead-ins being connected to respective electrodes which are spaced apart in said central barrel, a pair of first rings around respective end plugs, each first ring comprising a conductive coating on said end plug, and a conductive antenna connecting said first rings.

2. A lamp as in claim 1 wherein said antenna is a conductive coating on said ceramic arc tube.

3. A lamp as in claim 2 wherein said first rings and said antenna comprise tungsten.

4. A lamp as in claim 2 wherein said first rings and said antenna comprise graphite.

5. A lamp as in claim 2 further comprising a pair of conductive second rings connected by said antenna and spaced apart on said barrel adjacent respective said electrodes, each said second ring being a conductive coating.

6. A lamp as in claim 5 wherein said first rings, said second rings, and said antenna are electrically floating.

7. A lamp as in claim 1 wherein said first rings and said antenna are electrically floating.

* * * * *